US006012801A

United States Patent [19]

Nilsson

[11] Patent Number: 6,012,801

[45] Date of Patent: Jan. 11, 2000

[54] DIRECT PRINTING METHOD WITH IMPROVED CONTROL FUNCTION

[75] Inventor: Daniel Nilsson, Göteborg, Sweden

[73] Assignee: Array Printers AB, Vastra Frolunda, Sweden

[21] Appl. No.: 08/801,868

[22] Filed: Feb. 18, 1997

[51] Int. Cl.[7] ..... G03G 15/00

[52] U.S. Cl. ..... 347/55; 347/120

[58] Field of Search ..... 347/10, 20, 55, 347/120

[56] References Cited

U.S. PATENT DOCUMENTS

| | | | |
|---|---|---|---|
| 3,566,786 | 3/1971 | Kaufer et al. . | |
| 3,689,935 | 9/1972 | Pressman et al. . | |
| 3,779,166 | 12/1973 | Pressman et al. . | |
| 3,815,145 | 6/1974 | Tisch et al. . | |
| 4,263,601 | 4/1981 | Nishimura et al. . | |
| 4,274,100 | 6/1981 | Pond . | |
| 4,353,080 | 10/1982 | Cross . | |
| 4,382,263 | 5/1983 | Fischbeck et al. | 347/55 |
| 4,384,296 | 5/1983 | Torpey . | |
| 4,386,358 | 5/1983 | Fischbeck . | |
| 4,470,056 | 9/1984 | Galetto et al. . | |
| 4,478,510 | 10/1984 | Fujii et al. . | |
| 4,491,794 | 1/1985 | Daley et al. . | |
| 4,491,855 | 1/1985 | Fujii et al. . | |
| 4,498,090 | 2/1985 | Honda et al. . | |
| 4,511,907 | 4/1985 | Fukuchi . | |
| 4,525,727 | 6/1985 | Kohashi et al. . | |
| 4,571,601 | 2/1986 | Teshima . | |
| 4,675,703 | 6/1987 | Fotland . | |

(List continued on next page.)

FOREIGN PATENT DOCUMENTS

| | | |
|---|---|---|
| 0345 024 A2 | 6/1989 | European Pat. Off. . |
| 0352 997 A2 | 1/1990 | European Pat. Off. . |
| 0377 208 A2 | 7/1990 | European Pat. Off. . |
| 0389 229 | 9/1990 | European Pat. Off. . |
| 0660 201 A2 | 6/1995 | European Pat. Off. . |
| 072 072 A2 | 7/1996 | European Pat. Off. . |
| 0 743 572 A1 | 11/1996 | European Pat. Off. . |
| 0752 317 A1 | 1/1997 | European Pat. Off. . |

(List continued on next page.)

OTHER PUBLICATIONS

E. Bassous, et al., "The Fabrication of High Precision Nozzles by the Anisotropic Etching of (100) Silicon", *J. Electrochem. Soc.: Solid–State Science and Technology*, vol. 125, No. 8, Aug. 1978, pp. 1321–1327.

Jerome Johnson, "An Etched Circuit Aperture Array for TonerJet® Printing", *IS&T's Tenth International Congress on Advances in Non–Impact Printing Technologies*, 1994, pp. 311–313.

"The Best of Both Worlds," Brochure of TonerJet® by Array Printers, *The Best of Both Worlds*, 1990.

*Primary Examiner*—N. Le
*Assistant Examiner*—Lamson D. Nguyen
*Attorney, Agent, or Firm*—Knobbe, Martens, Olson & Bear, LLP

[57] ABSTRACT

The present invention relates to a direct electrostatic printing method, in which a stream of computer generated signals, defining an image information, are converted to a pattern of electrostatic fields which selectively permit or restrict the transport of charged toner particles from a particle source toward a back electrode and control the deposition of those charged toner particles in an image configuration onto an image receiving medium. Particularly, the present invention refers to a direct electrostatic printing method performed in consecutive print cycles, each of which includes at least one development period ($t_b$) and at least one recovering period ($t_w$) subsequent to each development period ($t_b$), wherein the pattern of electrostatic fields is produced during at least a part of each development period ($t_b$) to selectively permit or restrict the transport of charged toner particles from a particle source toward a back electrode, and an electric field is produced during at least a part of each recovering period ($t_w$) to repel a part of the transported charged toner particles back toward the particle source.

13 Claims, 7 Drawing Sheets

U.S. PATENT DOCUMENTS

| | | | |
|---|---|---|---|
| 4,717,926 | 1/1988 | Hotomi . | |
| 4,743,926 | 5/1988 | Schmidlin et al. . | |
| 4,748,453 | 5/1988 | Lin et al. . | |
| 4,814,796 | 3/1989 | Schmidlin . | |
| 4,831,394 | 5/1989 | Ochiai et al. . | |
| 4,837,071 | 6/1989 | Tagoku et al. . | |
| 4,860,036 | 8/1989 | Schmidlin . | |
| 4,903,050 | 2/1990 | Schmidlin | 347/55 |
| 4,912,489 | 3/1990 | Schmidlin . | |
| 5,028,812 | 7/1991 | Bartky . | |
| 5,818,490 | 10/1998 | Larson . | |
| 5,847,733 | 12/1998 | Bern | 347/55 |
| 5,036,341 | 7/1991 | Larsson . | |
| 5,038,159 | 8/1991 | Schmidlin et al. . | |
| 5,057,855 | 10/1991 | Damouth . | |
| 5,072,235 | 12/1991 | Slowik et al. . | |
| 5,083,137 | 1/1992 | Badyal et al. . | |
| 5,095,322 | 3/1992 | Fletcher . | |
| 5,121,144 | 6/1992 | Larson et al. . | |
| 5,128,695 | 7/1992 | Maeda . | |
| 5,148,595 | 9/1992 | Doggett et al. . | |
| 5,170,185 | 12/1992 | Takemura et al. . | |
| 5,181,050 | 1/1993 | Bibl et al. . | |
| 5,204,696 | 4/1993 | Schmidlin et al. . | |
| 5,204,697 | 4/1993 | Schmidlin . | |
| 5,214,451 | 5/1993 | Schmidlin et al. . | |
| 5,229,794 | 7/1993 | Honman et al. . | |
| 5,235,354 | 8/1993 | Larson . | |
| 5,237,346 | 8/1993 | Da Costa et al. . | |
| 5,256,246 | 10/1993 | Kitamura . | |
| 5,257,045 | 10/1993 | Bergen et al. . | |
| 5,270,729 | 12/1993 | Stearns . | |
| 5,274,401 | 12/1993 | Doggett et al. . | |
| 5,307,092 | 4/1994 | Larson . | |
| 5,329,307 | 7/1994 | Takemura et al. . | |
| 5,374,949 | 12/1994 | Wada et al. . | |
| 5,386,225 | 1/1995 | Shibata . | |
| 5,402,158 | 3/1995 | Larson . | |
| 5,414,500 | 5/1995 | Furukawa . | |
| 5,446,478 | 8/1995 | Larson . | |
| 5,450,115 | 9/1995 | Bergen et al. . | |
| 5,453,768 | 9/1995 | Schmidlin . | |
| 5,473,352 | 12/1995 | Ishida . | |
| 5,477,246 | 12/1995 | Hirabayashi et al. . | |
| 5,477,250 | 12/1995 | Larson . | |
| 5,506,666 | 4/1996 | Masuda et al. . | |
| 5,508,723 | 4/1996 | Maeda . | |
| 5,515,084 | 5/1996 | Larson . | |
| 5,526,029 | 6/1996 | Larson et al. . | |
| 5,558,969 | 9/1996 | Uyttendaele et al. . | |
| 5,600,355 | 2/1997 | Wada | 347/55 |
| 5,614,932 | 3/1997 | Kagayama | 347/55 |
| 5,617,129 | 4/1997 | Chizuk, Jr. et al. . | |
| 5,625,392 | 4/1997 | Maeda . | |
| 5,640,185 | 6/1997 | Kagayama . | |
| 5,650,809 | 7/1997 | Kitamura . | |
| 5,666,147 | 9/1997 | Larson . | |
| 5,677,717 | 10/1997 | Ohashi . | |
| 5,708,464 | 1/1998 | Desie | 347/55 |
| 5,774,159 | 6/1998 | Larson . | |
| 5,805,185 | 9/1998 | Kondo | 347/55 |
| 5,818,480 | 10/1998 | Bern et al. . | |

FOREIGN PATENT DOCUMENTS

| | | |
|---|---|---|
| 0764 540 A2 | 3/1997 | European Pat. Off. . |
| 12 70 856 | 6/1968 | Germany . |
| 26 53 048 | 5/1978 | Germany . |
| 44-26333 | 11/1969 | Japan . |
| 55-55878 | 4/1980 | Japan . |
| 55-84671 | 6/1980 | Japan . |
| 55-87563 | 7/1980 | Japan . |
| 56-89576 | 7/1981 | Japan . |
| 58-044457 | 3/1983 | Japan . |
| 58-155967 | 9/1983 | Japan . |
| 62-248662 | 10/1987 | Japan . |
| 62-13356 | 11/1987 | Japan . |
| 01120354 | 5/1989 | Japan . |
| 05220963 | 8/1990 | Japan . |
| 04189554 | 8/1992 | Japan . |
| 4-268591 | 9/1992 | Japan . |
| 4282265 | 10/1992 | Japan . |
| 5208518 | 8/1993 | Japan . |
| 93331532 | 12/1993 | Japan . |
| 94200563 | 8/1994 | Japan . |
| 9048151 | 2/1997 | Japan . |
| 09118036 | 5/1997 | Japan . |
| 2108432 | 5/1983 | United Kingdom . |
| 9014960 | 12/1990 | WIPO . |
| 9201565 | 2/1992 | WIPO . |

DIRECT PRINTING METHOD WITH IMPROVED CONTROL FUNCTION

BACKGROUND OF THE INVENTION

1. Field of the Invention

The present invention relates to a direct electrostatic printing method, in which a stream of computer generated signals, defining an image information, are converted to a pattern of electrostatic fields on control electrodes arranged on a printhead structure, to selectively permit or restrict the passage of toner particles through the printhead structure and control the deposition of those toner particles in an image configuration onto an image receiving medium.

2. Description of the Related Art

Of the various electrostatic printing techniques, the most familiar and widely utilized is that of xerography wherein latent electrostatic images formed on a charged retentive surface are developed by a suitable toner material to render the images visible, the images being subsequently transferred to plain paper.

Another form of electrostatic printing is one that has come to be known as direct electrostatic printing (DEP). This form of printing differs from the above mentioned xerographic form, in that toner is deposited in image configuration directly onto plain paper. The novel feature of DEP printing is to allow simultaneous field imaging and toner transport to produce a visible image on paper directly from computer generated signals, without the need for those signals to be intermediately converted to another form of energy such as light energy, as it is required in electrophotographic printing.

A DEP printing device has been disclosed in U.S. Pat. No. 3,689,935, issued Sep. 5, 1972 to Pressman et al. Pressman et al. disclose a multilayered particle flow modulator comprising a continuous layer of conductive material, a segmented layer of conductive material and a layer of insulating material interposed therebetween. An overall applied field projects toner particles through apertures arranged in the modulator whereby the particle stream density is modulated by an internal field applied within each aperture.

A new concept of direct electrostatic printing was introduced in U.S. Pat. No. 5,036,341, granted to Larson, which is incorporated by reference herein. According to Larson, a uniform electric field is produced between a back electrode and a developer sleeve coated with charged toner particles. A printhead structure, such as a control electrode matrix, is interposed in the electric field and utilized to produce a pattern of electrostatic fields which, due to control in accordance with an image configuration, selectively open or close passages in the printhead structure, thereby permitting or restricting the transport of toner particles from the developer sleeve toward the back electrode. The modulated stream of toner particles allowed to pass through the opened passages impinges upon an image receiving medium, such as paper, interposed between the printhead structure and the back electrode.

According to the above method, a charged toner particle is held on the developer surface by adhesion forces, which are essentially proportional to $Q^2/d^2$, where d is the distance between the toner particle and the surface of the developer sleeve, and Q is the particle charge. The electric force required for releasing a toner particle from the sleeve surface is chosen to be sufficiently high to overcome the adhesion forces.

However, due to relatively large variations of the adhesion forces, toner particles exposed to the electric field through an opened passage are neither simultaneously released from the developer surface nor uniformly accelerated toward the back electrode. As a result, the time period from when the first particle is released until all released particles are deposited onto the image receiving medium is relatively long.

When a passage is opened during a development period $t_b$, a part of the released toner particles do not reach sufficient momentum to pass through the aperture until after the development period $L_b$ has expired. Those delayed particles will continue to flow through the passage even after closure, and their deposition will be delayed. This in turn may degrade print quality by forming extended, indistinct dots.

That drawback is particularly critical when using dot deflection control. Dot deflection control consists in performing several development steps during each print cycle to increase print resolution. For each development step, the symmetry of the electrostatic fields is modified in a specific direction, thereby influencing the transport trajectories of toner particles toward the image receiving medium. That method allows several dots to be printed through each single passage during the same print cycle, each deflection direction corresponding to a new dot location. To enhance the efficiency of dot deflection control, it is particularly essential to decrease the toner jet length (where the toner jet length is the time between the first particle emerging through the aperture and the last particle emerging through the aperture) and to ensure direct transition from a deflection direction to another, without delayed toner deposition.

Therefore, in order to achieve higher speed printing with improved print uniformity, and in order to improve dot deflection control, there is still a need to improve DEP methods to allow shorter toner transport time and reduce delayed toner deposition.

SUMMARY OF THE INVENTION

The present invention satisfies a need for improved DEP methods by providing high-speed transition from print conditions to non-print conditions and shorter toner transport time.

The present invention satisfies a need for higher speed DEP printing without delayed toner deposition.

The present invention further satisfies high speed transition from a deflection direction to another, and thereby improved dot deflection control.

A DEP method in accordance with the present invention is performed in consecutive print cycles, each of which includes at least one development period $t_b$ and at least one recovering period $t_w$ subsequent to each development period $t_b$.

A pattern of variable electrostatic fields is produced during at least a part of each development period ($t_b$) to selectively permit or restrict the transport of charged toner particles from a particle source toward a back electrode, and an electric field is produced during at least a part of each recovering period ($t_w$) to repel a part of the transported charged toner particles back toward the particle source.

A DEP method in accordance with the present invention includes the steps of:

providing a particle source, a back electrode and a printhead structure positioned therebetween, said printhead structure including an array of control electrodes connected to a control unit;

positioning an image receiving medium between the printhead structure and the back electrode; producing an electric potential difference between the particle source and the back electrode to apply an electric field which enables the transport of charged toner particles from the particle source toward the back electrode;

during each development period $t_b$, applying variable electric potentials to the control electrodes to produce a pattern of electrostatic fields which, due to control in accordance with an image configuration, open or close passages through the printhead structure to selectively permit or restrict the transport of charged particles from the particle source onto the image receiving medium;

and during each recovering period ($t_w$), applying an electric shutter potential to the control electrodes to produce an electric field which repels delayed toner particles back to the particle source.

According to the present invention, an appropriate amount of toner particles are released from the particle source during a development period $t_b$. At the end of the development period $t_b$, only a part of the released toner particles have already reached the image receiving medium. Of the remaining released toner articles, those which have already passed the printhead structure are accelerated toward the image receiving medium under influence of the shutter potential. The part of the released toner particles which, at the end of the development period $t_b$, are still located between the particle source and the printhead structure, are repelled back to the particle source under influence of the shutter potential.

According to the present invention, a printhead structure is preferably formed of a substrate layer of electrically insulating material, such as polyimid or the like, having a top surface facing the particle source, a bottom surface facing the image receiving medium and a plurality of apertures arranged through the substrate layer for enabling the passage of toner particles through the printhead structure. Said top surface of the substrate layer is overlaid with a printed circuit including the array of control electrodes and arranged such that each aperture is at least partially surrounded by a control electrode.

All control electrodes are connected to at least one voltage source which supplies a periodic voltage pulse oscillating between at least two voltage levels, such that a first voltage level is applied during each of said development periods $t_b$ and a second voltage level ($V_{shutter}$) is applied during each of said recovering periods $t_w$.

Each control electrode is connected to at least one driving unit, such as a conventional IC-driver which supplies variable control potentials having levels comprised in a range between $V_{off}$ and $V_{on}$, where $V_{off}$ and $V_{on}$ are chosen to be below and above a predetermined threshold level, respectively. The threshold level is determined by the force required to overcome the adhesion forces holding toner particles on the particle source.

According to another embodiment of the present invention, the printhead structure further includes at least two sets of deflection electrodes comprised in an additional printed circuit preferably arranged on said bottom surface of the substrate layer. Each aperture is at least partially surrounded by first and second deflection electrodes disposed around two opposite segments of the periphery of the aperture.

The first and second deflection electrodes are similarly disposed in relation to a corresponding aperture and are connected to first and second deflection voltage sources, respectively.

The first and second deflection voltage sources supply variable deflection potential D1 and D2, respectively, such that the toner transport trajectory is controlled by modulating the potential difference D1–D2. The dot size is controlled by modulating the amplitude levels of both deflection potentials D1 and D2, in order to produce converging forces for focusing the toner particle stream passing through the apertures.

Each pair of deflection electrodes are arranged symmetrically about a central axis of their corresponding aperture whereby the symmetry of the electrostatic fields remains unaltered as long as both deflection potentials D1 and D2 have the same amplitude.

All deflection electrodes are connected to at least one voltage source which supplies a periodic voltage pulse oscillating between a first voltage level, applied during each of said development periods $t_b$, and a second voltage level ($V_{shutter}$), applied during each of said recovering periods $t_w$. The shutter voltage level applied to the deflection electrodes may differ in voltage level and timing from the shutter voltage applied to the control electrodes.

According to that embodiment, a DEP method is performed in consecutive print cycles each of which includes at least two development periods $t_b$ and at least one recovering period $t_w$ subsequent to each development period $t_b$, wherein:

a pattern of variable electrostatic fields is produced during at least a part of each development period ($t_b$) to selectively permit or restrict the transport of charged toner particles from a particle source toward a back electrode;

for each development period ($t_b$), a pattern of deflection fields is produced to control the trajectory and the convergence of the transported toner particles; and an electric field is produced during at least a part of each recovering period ($t_w$) to repel a part of the transported charged toner particles back toward the particle source.

According to that embodiment, a DEP method includes the steps of:

producing an electric potential difference between the particle source and the back electrode to apply an electric field which enables the transport of charged toner particles from the particle source toward the back electrode;

during each development period $t_b$, applying variable electric potentials to the control electrodes to produce a pattern of electrostatic fields which, due to control in accordance with an image configuration, open or close passages through the printhead structure to selectively permit or restrict the transport of charged particles from the particle source onto the image receiving medium;

during at least one development period $t_b$ of each print cycle, producing an electric potential difference D1–D2 between two sets of deflection electrodes to modify the symmetry of each of said electrostatic fields, thereby deflecting the trajectory of the transported particles;

during each recovering period ($t_w$), applying an electric shutter potential to each set of deflection electrodes to create an electric field between the deflection electrodes and the back electrodes to accelerate toner particles to the image receiving medium; and during each recovering period ($t_w$), applying an electric shutter potential to the control electrodes to produce an electric field between the control electrodes and the particle source to repel delayed toner particles back to the particle source.

According to that embodiment, the deflection potential difference is preserved during at least a part of each recovering period $t_w$, until the toner deposition is achieved. After each development period, a first electric field is produced between a shutter potential on the deflection electrodes and the background potential on the back electrode. Simultaneously, a second electric field is produced between a shutter potential on the control electrodes and the potential of the particle source (preferably 0V). The toner particles which, at the end of the development period $t_b$, are located between the printhead structure and the back electrode are accelerated toward the image receiving medium under influence of said first electric field. The toner particles which, at the end of the development period $t_b$, are located between the particle source and the printhead structure are repelled back onto the particle source under influence of said second electric field.

The present invention also refers to a control function in a direct electrostatic printing method, in which each print cycle includes at least one development period $t_b$ and at least one recovering period $t_w$ subsequent to each development period $t_b$. The variable control potentials are supplied to the control electrodes during at least a part of each development period $t_b$, and have amplitude and pulse width chosen as a function of the intended print density. The shutter potential is applied to the control electrodes during at least a part of each recovering period $t_w$.

The present invention also refers to a direct electrostatic printing device for accomplishing the above method.

The objects, features and advantages of the present invention will become more apparent from the following description when read in conjunction with the accompanying figures in which preferred embodiments of the invention are shown by way of illustrative examples.

Although the examples shown in the accompanying Figures illustrate a method wherein toner particles have negative charge polarity, that method can be performed with particles having positive charge polarity without departing from the scope of the present invention. In that case all potential values will be given the opposite sign.

DETAILED DESCRIPTION OF THE PREFERRED EMBODIMENT

Figure 1:
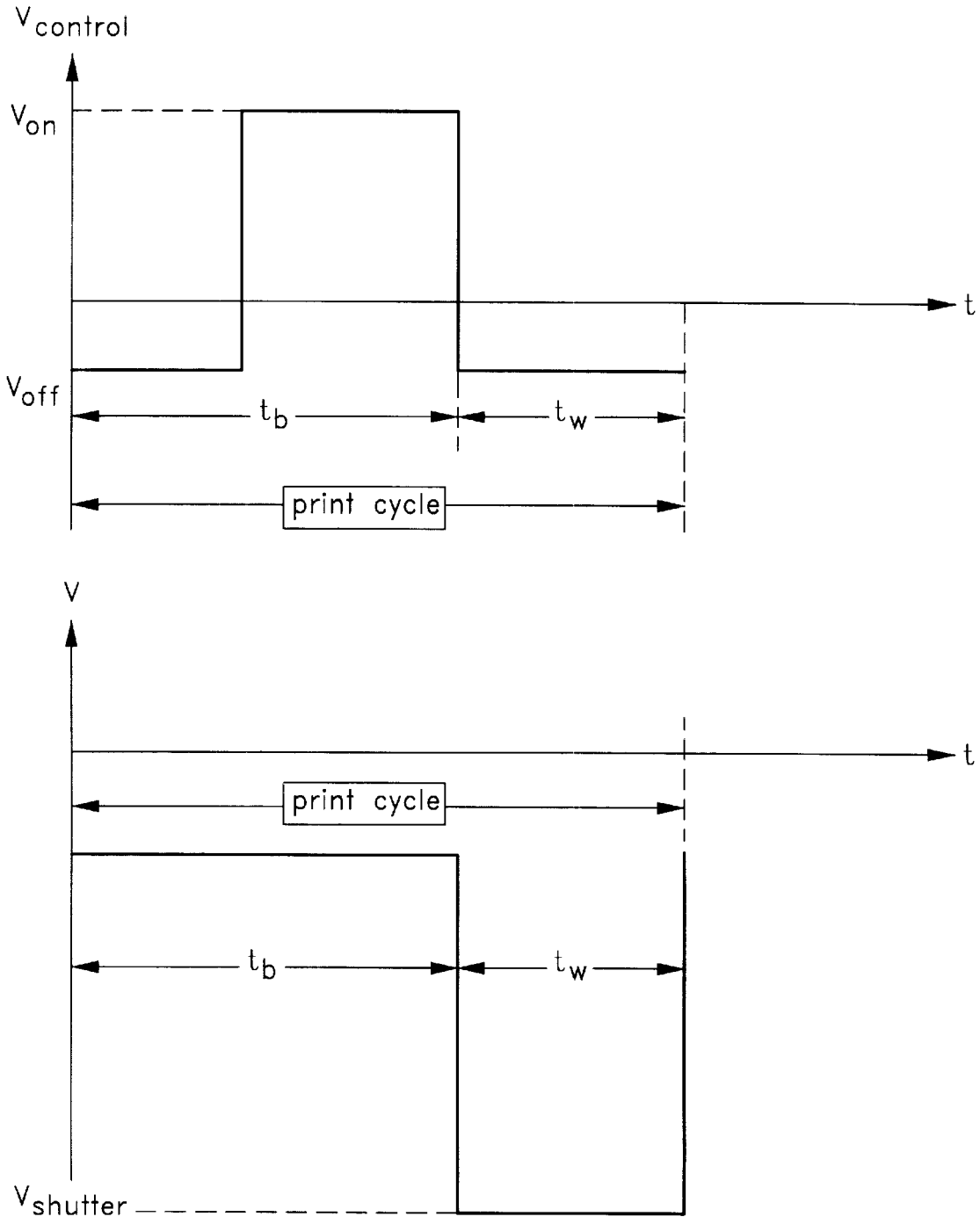
FIG. 1 is a diagram showing the voltages applied to a selected control electrode during a print cycle including a development period $t_b$ and a recovering period $t_w$.

FIG. 1 shows the control potential ($V_{control}$) and the periodic voltage pulse (V) applied on a control electrode during a print cycle. According to this example, the print cycle includes one development period $t_b$ and one subsequent recovering period $t_w$. The control potential ($V_{control}$) has an amplitude comprised between a white level $V_{off}$ and a full density level $V_{on}$. The control potential ($V_{control}$) has a pulse width which can vary between 0 and the entire development period $t_b$. When the pulse width is shorter than $t_b$, the whole control potential pulse is delayed so that it ends at $t=t_b$. At $t=t_b$, the periodic voltage pulse V is switched from a first level to a shutter level ($V_{shutter}$). The shutter potential has the same sign as the charge polarity of the toner particles, thereby applying repelling forces on the toner particles. Those repelling forces are directed away from the control electrodes whereby all toner particles which have already passed the apertures are accelerated toward the back electrode, while toner particles which are still located in the gap between the particle source and the control electrodes at $t=t_b$ are reversed toward the particle source.

Figure 2:
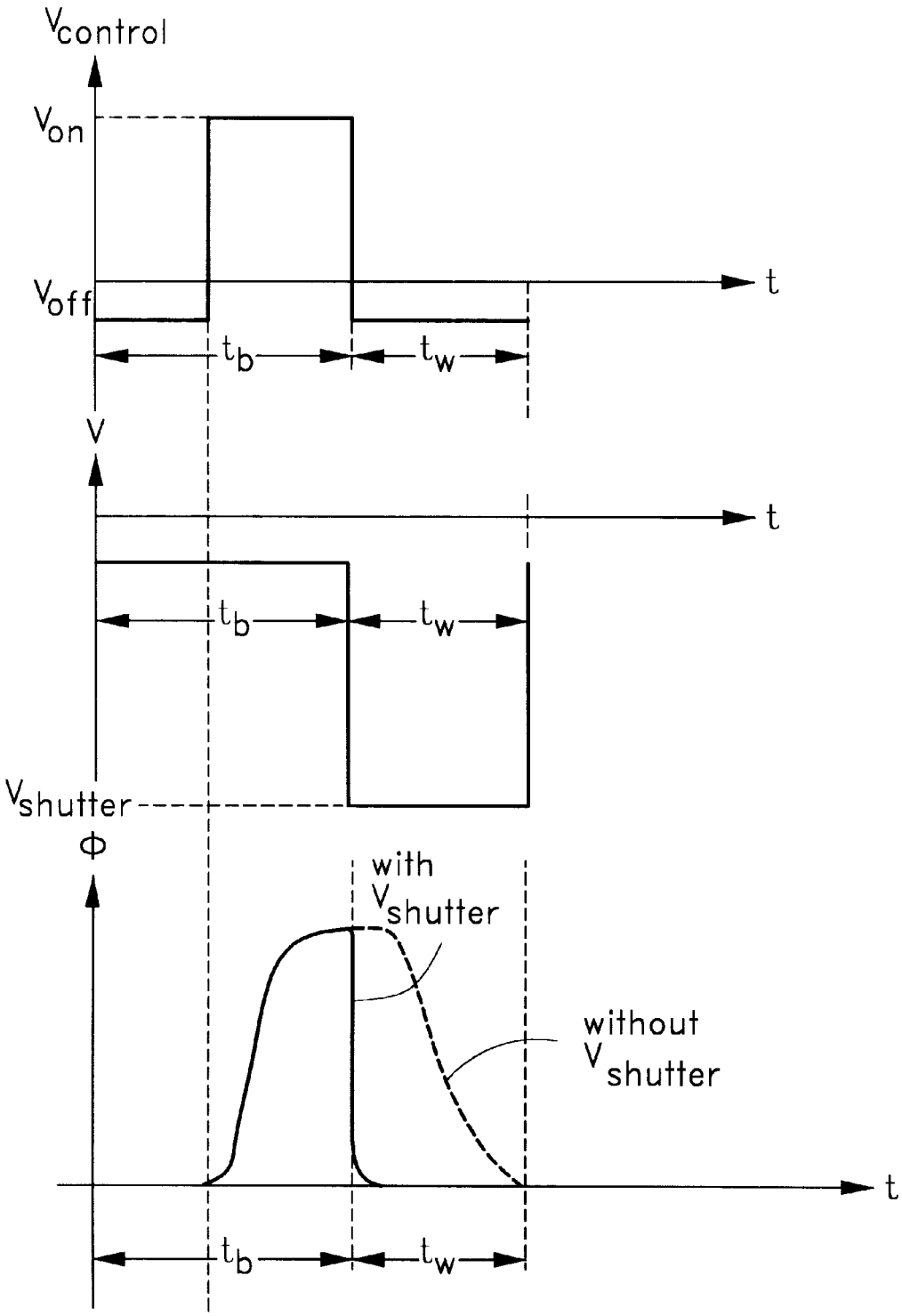
FIG. 2 is a diagram showing control function of FIG. 1 and the resulting particle flow density Φ, compared to prior art (dashed line).

As a result, the particle flow is cut off almost abruptly at $t=t_b$. FIG. 2 illustrates a print cycle as that shown in FIG. 1 and the resulting particle flow density, i.e., the number of particles passing through the aperture during a print cycle. The dashed line in FIG. 2 shows the particle flow density Φ as it would have been without applying a shutter potential (prior art). At t=0, toner particles are held on the particle source. As soon as the control potential is switched on, particles begin to be released from the particle source and projected through the aperture. The particle flow density Φ is rapidly shut off by applying the shutter potential at $t=t_b$.

Figure 3:
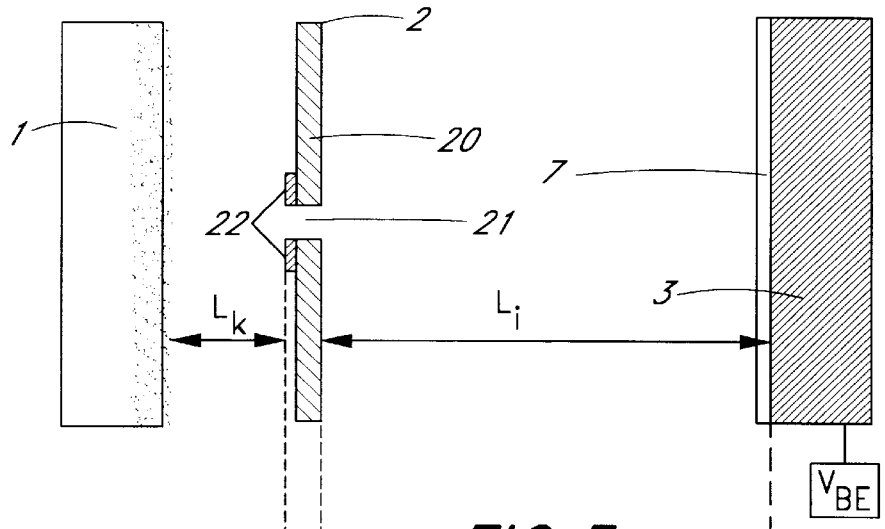
FIG. 3 is a schematic section view of a print zone of a DEP device.
Figure 9:
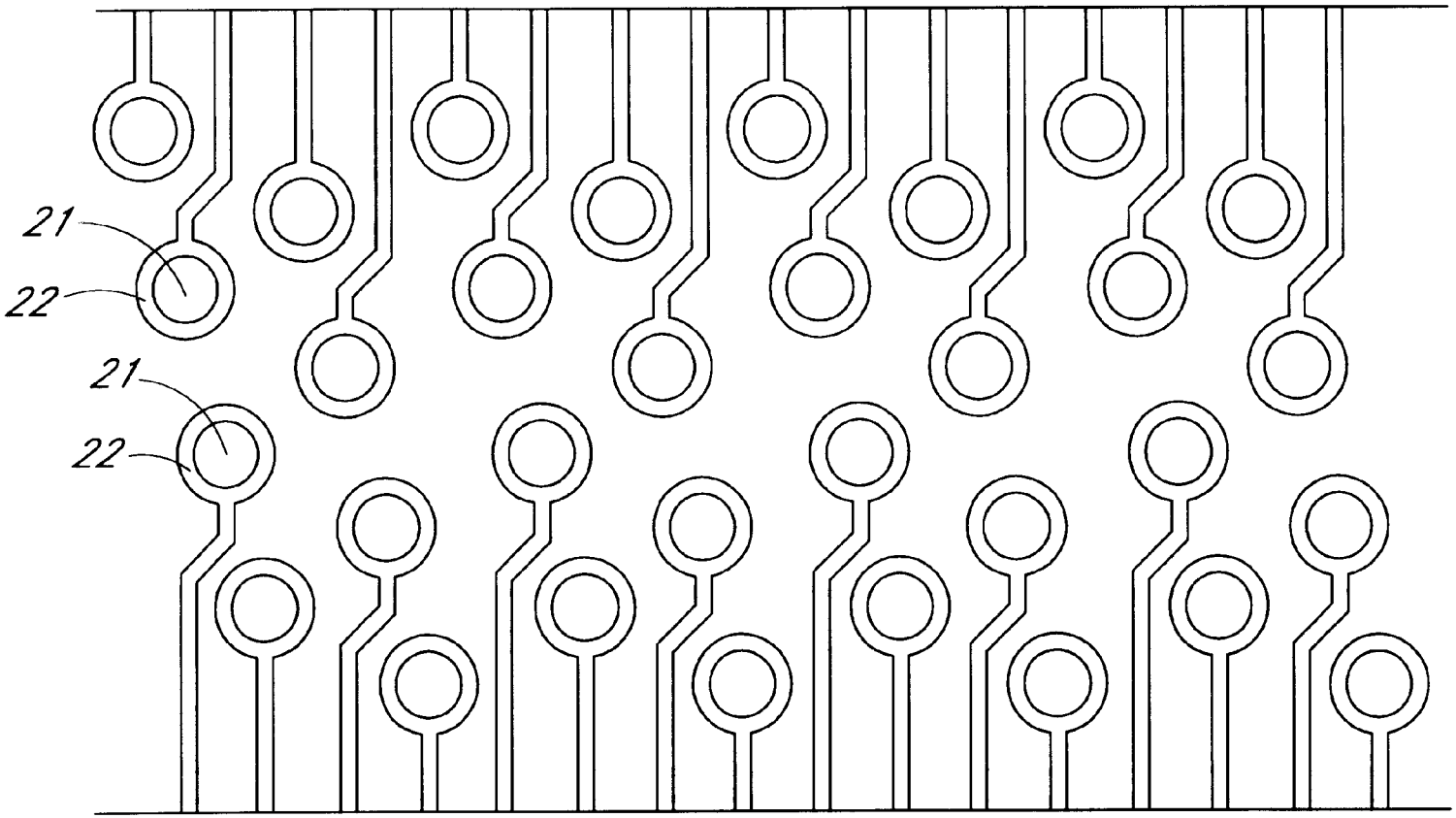
FIG. 9 illustrates an exemplary array of apertures surrounded by control electrodes.

FIG. 3 is a schematic section view through a print zone in a direct electrostatic printing device. The print zone comprises a particle source 1, a back electrode 3 and a printhead structure 2 arranged therebetween. The printhead structure 2 is located at a predetermined distance $L_k$ from the particle source and at a predetermined distance $L_i$ from the back electrode. The printhead structure 2 includes a substrate layer 20 of electrically insulating material having a plurality of apertures 21, arranged through the substrate layer 20, each aperture 21 being at least partially surrounded by a control electrode 22. The apertures 21 form an array, as illustrated, for example, in FIG. 9. An image receiving medium 7 is conveyed between the printhead structure 2 and the back electrode 3.

A particle source 1 is preferably arranged on a rotating developer sleeve having a substantially cylindrical shape and a rotation axis extending parallel to the printhead structure 2. The sleeve surface is coated with a layer of charged toner particles held on the sleeve surface by adhesion forces due to charge interaction with the sleeve material. The developer sleeve is preferably made of metallic material even if a flexible, resilient material is preferred for some applications. The toner particles are generally nonmagnetic particles having negative charge polarity and a narrow charge distribution in the order of about 4 to 10 $\mu$C/g. The printhead structure is preferably formed of a thin substrate layer of flexible, non-rigid material, such as polyimid or the like, having dielectrical properties. The substrate layer 20 has a top surface facing the particle source and a bottom surface facing the back electrode, and is provided with a plurality of apertures 21 arranged therethrough in one or several rows extending across the print zone. Each aperture is at least partially surrounded by a preferably ring-shaped control electrode of conductive material, such as for instance copper, arranged in a printed circuit preferably etched on the top surface of the substrate layer. Each control electrode is individually connected to a variable voltage source, such as a conventional IC driver, which, due to control in accordance with the image information, supplies the variable control potentials in order to at least partially open or close the apertures as the dot locations pass beneath the printhead structure. All control electrodes are connected to an additional voltage source which supplies the periodic voltage pulse oscillating from a first potential level applied during each development period $t_b$ and a shutter potential level applied during at least a part of each recovering period $t_w$.

Figure 4:
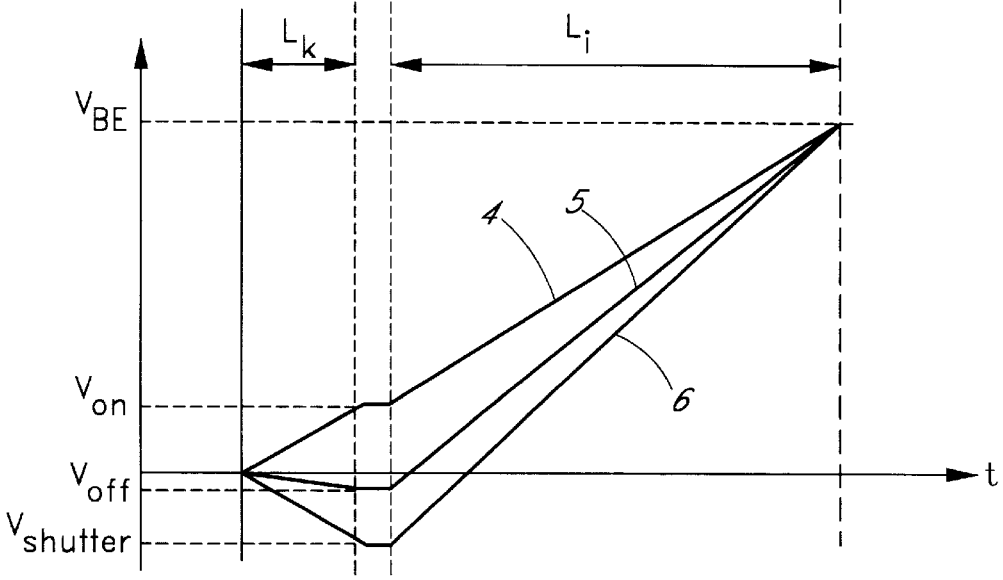
FIG. 4 is a diagram illustrating the electric potential as a function of the distance from the particle source to the back electrode, referring to the print zone of FIG. 3.

FIG. 4 is a schematic diagram showing the applied electric potential as a function of the distance d from the particle source I to the back electrode 3. Line 4 shows the potential function during a development period $t_b$, as the control potential is set on print condition ($V_{on}$). Line 5 shows the potential function during a development period $t_b$, as the control potential is set in nonprint condition ($V_{off}$). Line 6 shows the potential function during a recovering period $t_w$, as the shutter potential is applied ($V_{shutter}$). As apparent from FIG. 4, a negatively charged toner particle located in the region is transported toward the back electrode as long as the print potential $V_{on}$ is applied (line 4) and is repelled back toward the particle source as soon as the potential is switched to the shutter level (line 6). At the same time, a negatively charged toner particle located in the $L_i$-region is accelerated toward the back electrode as the potential is switched from $V_{on}$ (line 4) to $V_{shutter}$ (line 6).

Figure 5:
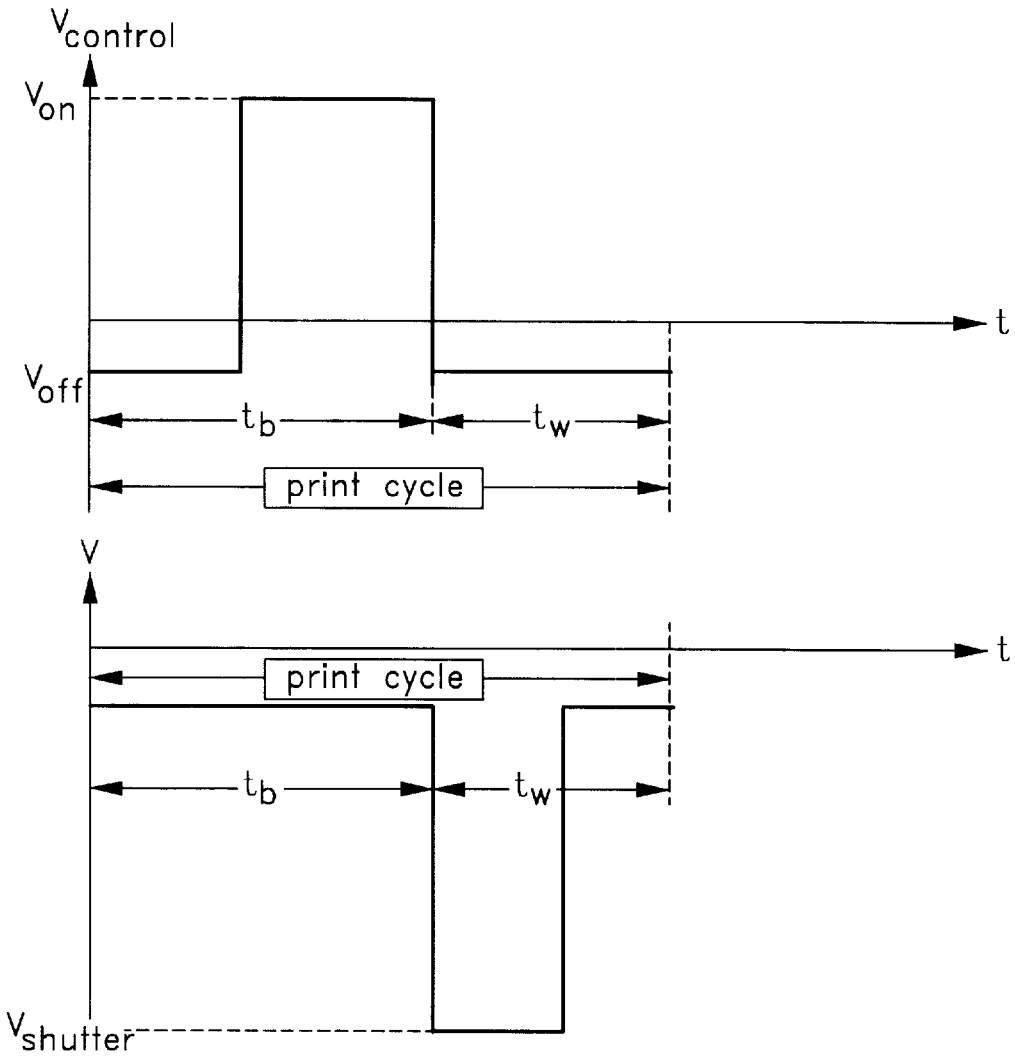
FIG. 5 is a diagram showing the voltages applied to a selected control electrode during a print cycle, according to another embodiment of the invention.

FIG. 5 shows an alternate embodiment of the invention, in which the shutter potential is applied only during a part of each recovering period $t_w$.

Figure 6:
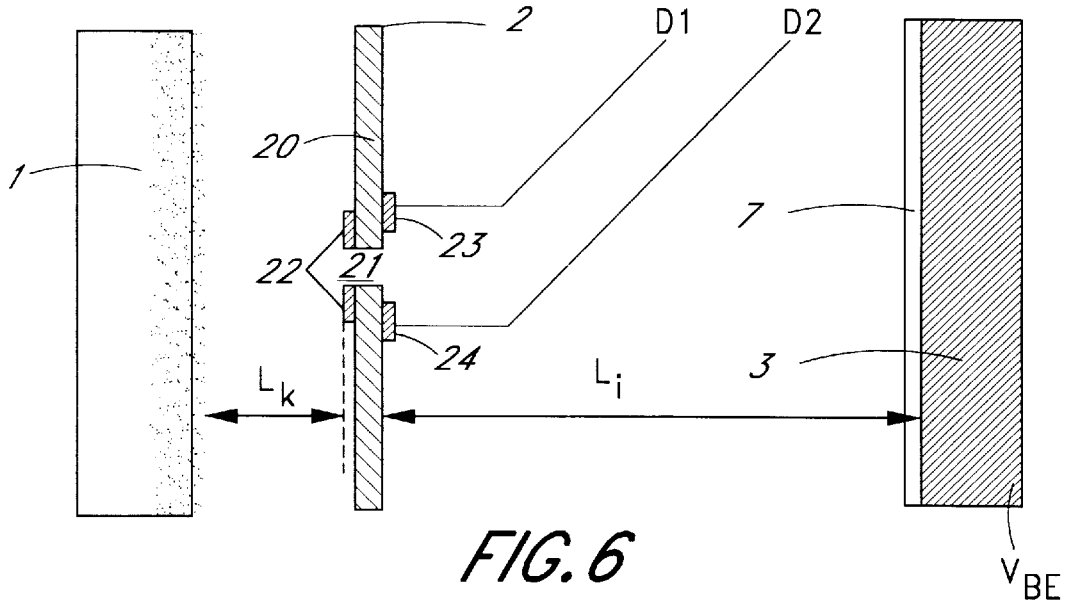
FIG. 6 is a schematic section view of a print zone of a DEP device according to another embodiment of the invention, in which the printhead structure includes deflection electrodes.

According to another embodiment of the present invention, shown in FIG. 6, the printhead structure 2 includes an additional printed circuit preferably arranged on the bottom surface of the substrate layer 20 and comprising at least two different sets of deflection electrodes 23, 24, each of which set is connected to a deflection voltage source (D1, D2). By producing an electric potential difference between both deflection voltage sources (D1, D2), the symmetry of the electrostatic fields produced by the control electrodes 22 is influenced in order to slightly deflect the transport trajectory of the toner particles.

Figure 7:
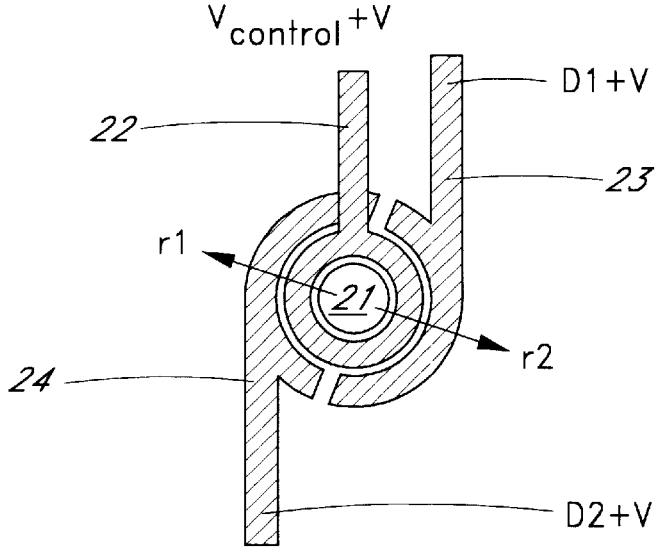
FIG. 7 is a schematic view of an aperture, its associated control electrode and deflection electrodes, and the voltages applied thereon.

As apparent from FIG. 7, the deflection electrodes 23, 24 are disposed in a predetermined configuration such that each aperture 21 is partly surrounded by a pair of deflection electrodes 23, 24 included in different sets. Each pair of deflection electrodes 23, 24 is so disposed around the apertures, that the electrostatic field remains symmetrical about a central axis of the aperture as long as both deflection voltages D1, D2 have the same amplitude. As a first potential difference (D1<D2) is produced, the stream is deflected in a first direction r1. By reversing the potential difference (D1>D2) the deflection direction is reversed to an opposite direction r2. The deflection electrodes have a focusing effect on the toner particle stream passing through the aperture and a predetermined deflection direction is obtained by adjusting the amplitude difference between the deflection voltages.

In that case, the method is performed in consecutive print cycles, each of which includes several, for instance two or three, development periods $t_b$, each development period corresponding to a predetermined deflection direction. As a result, several dots can be printed through each aperture during one and same print cycle, each dot corresponding to a particular deflection level. That method allows higher print resolution without the need of a larger number of control voltage sources (IC-drivers). When performing dot deflection control, it is an essential requirement to achieve a high speed transition from one deflection direction to another.

Figure 8A:
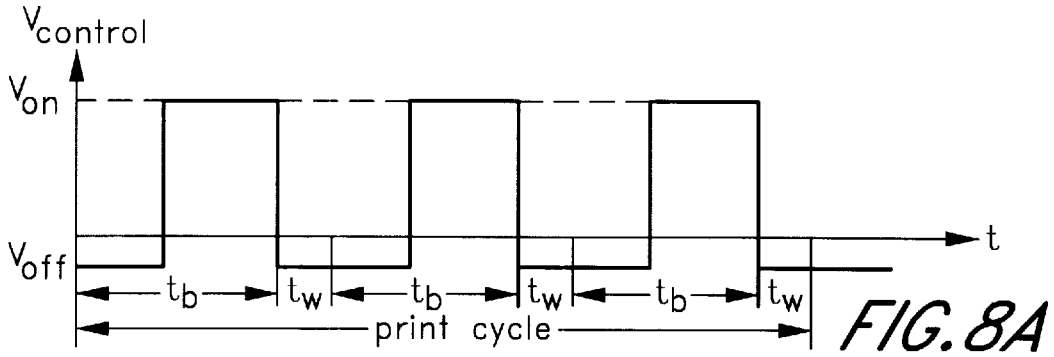
FIG. 8*a* is a diagram showing the control voltages applied to a selected control electrode during a print cycle including three development periods $t_b$ and three recovering periods $t_w$, utilizing dot deflection control.
Figure 8B:
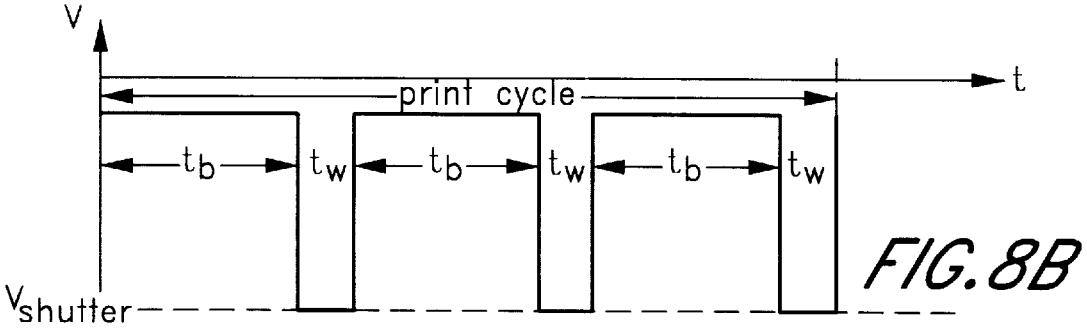
FIG. 8*b* is a diagram showing the periodic voltage pulse V applied to all control electrodes and deflection electrodes during a print cycle including three development periods $t_b$ and three recovering periods $t_w$, utilizing dot deflection control.
Figure 8C:
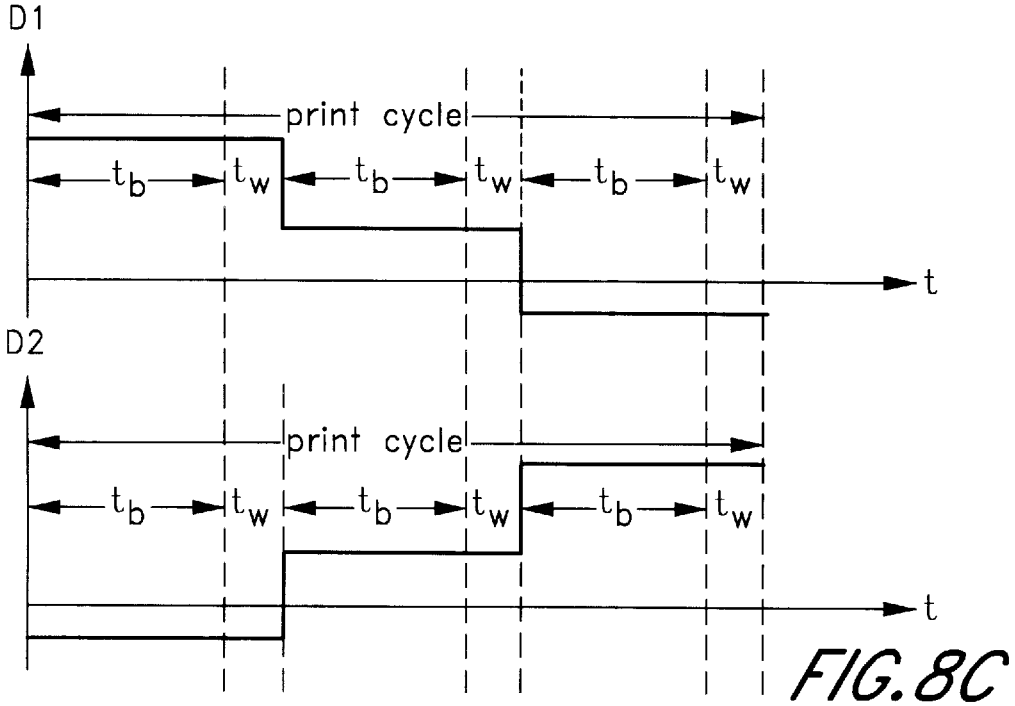
FIG. 8*c* is a diagram showing the deflection voltages D1 and D2 applied to first and second sets of deflection electrodes, respectively, utilizing dot deflection control with three different deflection levels.

The present invention is advantageously carried out in connection with dot deflection control, as apparent from FIG. 8*a*, 8*b*, 8*c*. FIG. 8*a* is a diagram showing the control voltages applied on a control electrodes during a print cycle including three different development periods $t_b$, each of which is associated with a specific deflection level, in order to print three different, transversely aligned, adjacent dots through one and same aperture.

FIG. 8*b* shows the periodic voltage pulse. According to a preferred embodiment of the invention, the periodic voltage pulse is simultaneously applied on all control electrodes and on all deflection electrodes. In that case each control electrode generates an electrostatic field produced by the superposition of the control voltage pulse and the periodic voltage pulse, while each deflection electrode generates a deflection field produced by the superposition of the deflection voltages and the periodic voltage pulse. Note that the shutter voltage in FIG. 8*b* applied to the deflection electrodes may advantageously differ from the shutter voltage in FIG. 5 applied to the control electrodes. For example, the deflection electrode shutter voltage may have a different wave shape or a different amplitude than the control electrode shutter voltage, and it may also be delayed with respect to the pulses applied to the control electrodes.

FIG. 8*c* shows the deflection voltages applied on two different sets of deflection electrodes (D1, D2). During the first development period, a potential difference D1>D2 is created to deflect the particle stream in a first direction. During the second development period, the deflection potentials have the same amplitude, which results in printing a central located dot. During the third development period, the potential difference is reversed (D1<D2) in order to obtain a second deflection direction opposed to the first. The superposition of the deflection voltages and the periodic pulse produce a shutter potential, while maintaining the deflection potential difference during each recovering period.

Although it is preferred to perform three different deflection steps (for instance left, center, right), the above concept is obviously not limited to three deflection levels. In some application two deflection levels (for instance left, right) are advantageously performed in a similar way. The dot deflection control allows a print resolution of for instance 600 dpi utilizing a 200 dpi printhead structure and performing three deflection steps. A print resolution of 600 dpi is also obtained by utilizing a 300 dpi printhead structure performing two deflection steps. The number of deflection steps can be increased (for instance four or five) depending on different requirements such as for instance print speed, manufacturing costs or print resolution.

According to another embodiments of the invention, the periodic voltage pulse is applied only to all deflection electrodes or only to all control electrodes.

An image receiving medium 7, such as a sheet of plain untreated paper or any other medium suitable for direct printing, is caused to move between the printhead structure 2 and the back electrode 3. The image receiving medium may also consist of an intermediate transfer belt onto which toner particles are deposited in image configuration before being applied on paper or other information carrier. An intermediate transfer belt may be advantageously utilized in order to ensure a constant distance $L_t$ and thereby a uniform deflection length.

In a particular embodiment of the invention, the control potentials are supplied to the control electrodes using driving means, such as conventional IC-drivers (push-pull) having typical amplitude variations of about 325V. Such an IC-driver is preferably used to supply control potential in the range of −50V to +275V for $V_{off}$ and $V_{on}$, respectively. The periodic voltage pulse is preferably oscillating between a first level substantially equal to $V_{off}$ (i.e., about −50V) to a shutter potential level in the order of $-V_{on}$ (i.e., about −325V). The amplitude of each control potential determines the amount of toner particles allowed to pass through the aperture. Each amplitude level comprised between $V_{off}$ and $V_{on}$ corresponds to a specific shade of gray. Shades of gray are obtained either by modulating the dot density while maintaining a constant dot size, or by modulating the dot size itself. Dot size modulation is obtained by adjusting the levels of both deflection potentials in order to produce variable converging forces on the toner particle stream. Accordingly, the deflection electrodes are utilized to produce repelling forces on toner particles passing through an aperture such that the transported particles are caused to converge toward each other resulting in a focused stream and thereby a smaller dot. Gray scale capability is significantly enhanced by modulating those repelling forces in accordance with the desired dot size. Gray scale capabilities may also be enhanced by modulating the pulse width of the applied control potentials. For example, the timing of the beginning of the control pulse may be varied. Alternatively, the pulse may be shifted in time so that it begins earlier and no longer ends at the beginning of the shutter pulse.

From the foregoing it will be recognized that numerous variations and modifications may be effected without departing from the scope of the invention as defined in the appended claims.

What is claimed is:

1. A direct electrostatic print unit comprising:

a particle source;

a back electrode;

a background voltage source connected to the back electrode to produce an electric potential difference between the back electrode and the particle source;

a printhead structure positioned between the back electrode and the particle source, comprising:

a substrate layer of electrically insulating material having a top surface facing the particle source and a bottom surface facing the back electrode;

a plurality of apertures arranged through the substrate layer;

a first printed circuit arranged on said top surface of the substrate layer, including a plurality of control electrodes, each of which at least partially surrounds a corresponding aperture;

a plurality of control voltage sources, each of which is connected to a corresponding control electrode to supply variable electric potentials to control the stream of charged toner particles through the corresponding aperture during at least one development period wherein the stream of charged toner particles are transported toward the back electrode;

at least one voltage source connected to the control electrodes to supply a periodic voltage pulse to cut off the stream of charged toner particles after the at least one development period;

a second printed circuit arranged on said bottom surface of the substrate layer, including at least two sets of deflection electrodes;

at least one deflection voltage source connected to each set of deflection electrodes to supply deflection potentials which control the transport trajectory of toner particles; and at least one voltage source connected to each set of deflection electrodes to supply a periodic voltage pulse to cut off the stream of charged toner particles after said at least one development period.

2. A direct electrostatic printing method performed in consecutive print cycles, each of which includes at least two development periods during which toner particles are selectively transported toward a back electrode and at least one recovering period subsequent to each development period during which toner particles are repelled toward a particle source, the method comprising the steps of:

generating a pattern of variable electrostatic fields during at least a part of each development period to selectively permit or restrict the transport of charged toner particles from a particle source toward a back electrode;

generating a pattern of deflection fields;

applying the pattern of deflection fields to influence the trajectory of the transported charged toner particles; and generating a second electric field during at least a part of each recovering period to repel a part of the transported charged toner particles back toward the particle source.

3. The method as defined in claim 2, wherein the pattern of variable electrostatic fields and the second electric field are generated by a periodic voltage pulse oscillating from a first amplitude level applied during said at least two development periods, and a second amplitude level, applied during at least a part of said at least one recovering period.

4. The method as defined in claim 2, wherein the pattern of deflection fields is applied during at least one of said at least two development periods.

5. The method as defined in claim 4, wherein the pattern of deflection fields is applied at the same time as the pattern of electrostatic fields.

6. The method as defined in claim 2, wherein the pattern of deflection fields is applied during at least one of said at least two development periods and during at least a part of said at least one recovering period.

7. The method as defined in claim 6, wherein the pattern of deflection fields is applied at the same time as the pattern of electrostatic fields.

8. The method as defined in claim 2, wherein each of said at least two development periods corresponds to a predetermined pattern of deflection fields.

9. The method as defined in claim 2, wherein each of said at least two development periods corresponds to a predetermined pattern of deflection fields, each pattern corresponding to a predetermined trajectory of the transported particles.

10. The method as defined in claim 2, wherein each of said at least two development periods corresponds to a predetermined pattern of deflection fields, each pattern being produced during the corresponding development period and at least a part of said at least one subsequent recovering period.

11. A direct electrostatic printing method performed in consecutive print cycles, each of which includes at least two development periods during which toner particles are selectively transported toward a back electrode and at least one recovering period subsequent to each development period during which toner particles are repelled toward a particle source, said method comprising the steps of:

providing a particle source, a back electrode, and a printhead a structure positioned therebetween, said printhead structure including an array of control electrodes and at least two sets of deflection electrodes;

providing an image receiving medium between the array of control electrodes and the back electrode;

producing an electric potential difference between the particle source and the back electrode to enable the transport of charged toner particles from the particle source toward the image receiving medium;

applying variable electric potentials to the control electrodes during each of at least two development periods to produce a pattern of electrostatic fields which, due to control in accordance with an image configuration, selectively permit or restrict the transport of charged particles from the particle source onto the image receiving medium;

supplying a first variable deflection potential to a first set of deflection electrodes, and a second variable deflection potential to a second set of deflection electrodes;

producing an electric potential difference between the first variable deflection potential and the second variable deflection potential during at least one of said at least two development periods to influence the symmetry of said electrostatic fields, thereby deflecting the transport trajectory of toner particles in a predetermined deflection direction, said method further including the step of:

connecting at least one voltage source to all deflection electrodes to supply a periodic voltage pulse which oscillates between a first potential level, applied during each development period, and a second potential level applied during at least a part of each recovering period, wherein the second potential level of the periodic voltage pulse repels delayed toner particles back toward the particle source.

12. The method as defined in claim 11, wherein each print cycle includes three development periods, and one recovering period subsequent to each development period, wherein:

the transport trajectory of toner particles is deflected in a first direction during a first development period and its subsequent recovering period, forming a first deflected dot on one side of a central dot;

the transport trajectory of toner particles is undeflected during a second development period and its subsequent recovering period forming said central dot; and the transport trajectory of toner particles is deflected in a second direction during a third development period and its subsequent recovering period forming a second deflected dot on the opposite side of the central dot.

13. The method as defined in claim 11, wherein each print cycle includes two development periods, and one recovering period subsequent to each development period.

* * * * *